US007348462B2

(12) United States Patent
Fenouil et al.

(10) Patent No.: US 7,348,462 B2
(45) Date of Patent: Mar. 25, 2008

(54) PROCESS FOR PREPARING BRANCHED OLEFINS FROM A PARAFFINIC WAX

(75) Inventors: Laurent Alain Michel Fenouil, Twickenham (GB); Brendan Dermot Murray, Houston, TX (US); Paul Marie Ayoub, Houston, TX (US)

(73) Assignee: Shell Oil Company, Houston, TX (US)

( * ) Notice: Subject to any disclaimer, the term of this patent is extended or adjusted under 35 U.S.C. 154(b) by 730 days.

(21) Appl. No.: 10/789,115

(22) Filed: Feb. 27, 2004

(65) Prior Publication Data

US 2004/0167368 A1 Aug. 26, 2004

Related U.S. Application Data

(62) Division of application No. 10/075,318, filed on Feb. 14, 2002, now Pat. No. 6,747,165.

(60) Provisional application No. 60/269,064, filed on Feb. 15, 2001.

(51) Int. Cl.

| | |
|---|---|
| ***C10L 5/00*** | (2006.01) |
| ***C10L 1/16*** | (2006.01) |
| ***C10M 101/02*** | (2006.01) |
| ***C10M 107/00*** | (2006.01) |
| ***C10M 143/00*** | (2006.01) |
| ***C10M 165/00*** | (2006.01) |
| ***C10M 167/00*** | (2006.01) |
| ***C10M 169/00*** | (2006.01) |
| ***C10M 171/00*** | (2006.01) |

(52) U.S. Cl. ..... 585/13; 585/654

(58) Field of Classification Search ..... 585/310, 585/324, 660, 661, 654; 510/155; 558/41; 568/910.5; 562/32

See application file for complete search history.

(56) References Cited

U.S. PATENT DOCUMENTS

| | | | | |
|---|---|---|---|---|
| 3,231,621 | A | 1/1966 | Slaugh | 260/604 |
| 3,239,566 | A | 3/1966 | Slaugh et al. | 260/604 |
| 3,239,569 | A | 3/1966 | Slaugh et al. | 260/632 |
| 3,239,570 | A | 3/1966 | Slaugh et al. | 260/632 |
| 3,239,571 | A | 3/1966 | Slaugh et al. | 260/632 |
| 3,253,055 | A | 5/1966 | Goble et al. | 260/683.75 |
| 3,274,287 | A | 9/1966 | Moore et al. | 260/683.3 |
| 3,315,007 | A | 4/1967 | Abell, Jr. et al. | 260/683.3 |
| 3,315,008 | A | 4/1967 | Abell, Jr. et al. | 260/683.3 |
| 3,420,875 | A | 1/1969 | Di Salvo et al. | 260/513 |
| 3,420,898 | A | 1/1969 | Van Winkle et al. | 260/632 |
| 3,427,342 | A | 2/1969 | Brooks et al. | 260/458 |
| 3,428,654 | A | 2/1969 | Rubinfeld et al. | 260/327 |
| 3,440,291 | A | 4/1969 | Van Winkle | 260/632 |
| 3,448,157 | A | 6/1969 | Slaugh | 260/604 |
| 3,448,158 | A | 6/1969 | Slaugh et al. | 260/604 |
| 3,462,525 | A | 8/1969 | Levinsky et al. | 424/56 |
| 3,496,203 | A | 2/1970 | Morris et al. | 260/439 |
| 3,496,204 | A | 2/1970 | Morris et al. | 260/439 |
| 3,501,515 | A | 3/1970 | Van Winkle | 260/439 |
| 3,506,580 | A | 4/1970 | Rubinfeld et al. | 252/138 |
| 3,524,864 | A | 8/1970 | Rubinfeld et al. | 260/327 |
| 3,527,818 | A | 9/1970 | Mason et al. | 260/632 |
| 3,562,797 | A | 2/1971 | Hu | 260/683.3 |
| 3,579,537 | A | 5/1971 | Rubinfeld | 260/327 |
| 3,709,817 | A | 1/1973 | Suggiti et al. | 208/112 |
| 3,711,399 | A | 1/1973 | Estes et al. | 208/112 |
| 3,745,112 | A | 7/1973 | Rausch | 208/139 |
| 3,755,146 | A | 8/1973 | Harris et al. | 208/112 |
| 4,430,517 | A * | 2/1984 | Imai et al. | 585/660 |
| 5,012,021 | A | 4/1991 | Vora et al. | 585/315 |
| 5,019,662 | A | 5/1991 | Vora et al. | 585/323 |
| 5,112,519 | A | 5/1992 | Giacobbe et al. | 252/174.21 |
| 5,218,086 | A | 6/1993 | Van Doorn et al. | 528/392 |
| 5,250,718 | A * | 10/1993 | Lutz | 558/41 |
| 5,510,306 | A | 4/1996 | Murray | 502/64 |

(Continued)

FOREIGN PATENT DOCUMENTS

| | | |
|---|---|---|
| EP | 0512635 | 5/1992 |

(Continued)

OTHER PUBLICATIONS

PCT Written Opinion for TH1854 PCT—International Patent Application No. PCT/EP02/01702.

(Continued)

*Primary Examiner*—Walter D. Griffin
*Assistant Examiner*—Frank C Campanell

(57) ABSTRACT

A process for preparing branched alkyl aromatic hydrocarbons, which process comprises contacting branched olefins with an aromatic hydrocarbon under alkylating conditions, which branched olefins have been obtained by a process which comprises dehydrogenating an isoparaffinic composition over a suitable catalyst which isoparaffinic composition has been obtained by hydrocracking and hydroisomerization of a paraffinic wax and which isoparaffinic composition comprises paraffins having a carbon number in the range of from 7 to 35, of which paraffins at least a portion of the molecules is branched, the average number of branches per paraffin molecule being at least 0.5 and the branching comprising methyl and optionally ethyl branches; a process for preparing (branched-alkyl)arylsulfonates, comprising sulfonating branched alkyl aromatic hydrocarbons which branched alkyl aromatic hydrocarbons have been prepared by the said process for preparing branched alkyl aromatic hydrocarbons; and branched alkyl aromatic hydrocarbon compositions and (branched-alkyl)arylsulfonate compositions which are obtainable by the processes so defined.

43 Claims, No Drawings

U.S. PATENT DOCUMENTS

| | | | | |
|---|---|---|---|---|
| 5,833,839 | A | 11/1998 | Wittenbrink et al. | 208/112 |
| 5,849,960 | A | 12/1998 | Singleton et al. | 568/909 |
| 5,866,748 | A * | 2/1999 | Wittenbrink et al. | 585/734 |
| 5,906,727 | A | 5/1999 | Wittenbrink et al. | 208/14 |
| 5,948,719 | A | 9/1999 | Johnson et al. | 502/73 |
| 6,013,171 | A | 1/2000 | Cook et al. | 208/27 |
| 6,037,506 | A | 3/2000 | Bolinger | 568/909 |
| 6,111,158 | A | 8/2000 | Marinangeli et al. | 585/467 |
| 6,187,981 | B1 * | 2/2001 | Marinangeli et al. | 585/323 |
| 6,566,565 | B1 | 5/2003 | Murray et al. | 568/909 |
| 6,747,165 | B2 | 6/2004 | Fenouil et al. | 558/41 |
| 6,756,411 | B2 | 6/2004 | Betts et al. | 518/701 |
| 6,765,106 | B2 | 7/2004 | Fenouil et al. | 558/41 |
| 7,087,777 | B2 | 8/2006 | Fenouil et al. | 558/41 |

FOREIGN PATENT DOCUMENTS

| | | |
|---|---|---|
| EP | 0654521 | 11/1994 |
| EP | 0903333 B1 | 7/2001 |
| WO | WO 97/01521 | 1/1997 |
| WO | WO 99/05082 | 2/1999 |
| WO | WO 99/05084 | 2/1999 |
| WO | WO 99/5244 | 2/1999 |
| WO | WO9905242 | 2/1999 |
| WO | WO 99/54277 | 10/1999 |
| WO | WO 01/05755 A1 | 1/2001 |
| WO | WO0105733 | 1/2001 |
| WO | WO02064532 | 8/2002 |
| WO | WO02064707 | 8/2002 |

OTHER PUBLICATIONS

"Microbial Polysaccharides" and "Molecular Sieves," *Kirk-Othmer Encyclopedia of Chemical Technology*, 4th Edition, vol. 1, pp. 589-591 and vol. 16, pp. 911-916.

"UOP Molex Process for Production of Normal Paraffins," by Stephen W. Sohn, *Handbook of Petroleum Refining Processes*, (R. A. Meyers, Ed.) 2nd Edition, pp. 10.45-10.51, 10.75-10.81.

"Oxo Process," *Kirk-Othmer Encyclopedia of Chemical Technology*, 3rd Edition, vol. 16, pp. 637-653.

Monohydric Alcohols: Manufacture, Applications and Chemistry, E. J. Wickson (Ed.), Am. Chem. Soc. 1981, pp. 156-164.

U.S. Appl. No. 10/965,256, filed Oct. 14, 2004, Ayoub et al.

Ed Radchenko et al., Ind. Catalysts for Oil . . . Mech Chem 1987, pp. 25-27.

* cited by examiner

PROCESS FOR PREPARING BRANCHED OLEFINS FROM A PARAFFINIC WAX

REFERENCE TO PRIOR APPLICATION

This is a division of application Ser. No. 10/075,318 filed Feb. 14, 2002, now U.S. Pat. No. 6,747,165, the entire disclosure of which is hereby incorporated by reference, which claims the benefit of U.S. Provisional Application No. 60/269,064 filed Feb. 15, 2001, the entire disclosure of which is hereby incorporated by reference.

FIELD OF THE INVENTION

This invention relates to a process for preparing (branched-alkyl)arylsulfonates and to compositions of the (branched-alkyl)arylsulfonates per se. This invention also relates to a process for preparing intermediate branched alkyl aromatic hydrocarbons and to compositions of the branched alkyl aromatic hydrocarbons per se.

BACKGROUND OF THE INVENTION

WO-99/05244, WO-99/05082 and U.S. Pat. No. 6,111,158 relate to alkylarylsulfonate surfactants of which the alkyl groups are branched. Sources of the alkyl groups are for example paraffins with limited branching obtained by delinearization of linear paraffins.

U.S. Pat. No. 5,849,960 relates to surfactant sulfates based on branched alcohols. The branched alcohols in question have an average number of branches per molecule chain of at least 0.5. The branching comprises not only methyl branching but also ethyl branches, whilst the occurrence of longer branching is not excluded. The branched alcohols are made from branched olefins, which are made by skeletally isomerizing linear olefins.

The market always asks for improvements in the performance of existing detergent formulations, inter alia by improving the surfactants present in the detergent formulations. For example, the laundry market asks for improvements in the surfactants' biodegradability, their cold water solubility and their cold water detergency. At least an improvement is sought in the balance of the properties. By the terminology "an improvement in the balance of the properties" it is meant that at least one property is improved, whilst at least one of the other properties is not deteriorated.

The present invention seeks to provide improvements in the performance of the known alkylarylsulfonate surfactants, or at least in an improvement in the balance of their performance properties. Relevant performance properties are biodegradability, cold water solubility and cold water detergency, for example cold water detergency in water of low hardness and in water of high hardness. Other relevant performance properties are the compatibility of the alkylarylsulfonate surfactants with other components present in detergent formulations, as described hereinafter, in particular, the compatibility with enzymes, i.e. the inability of the alkylarylsulfonate surfactants to denature enzymes during storage in an aqueous medium. Again other relevant performance properties, in particular for personal care applications, are mildness to the skin and to the eyes and the ability of high foaming, preferably providing foam with a fine structure of the foam cells. Further, an improved performance is sought as a chemical for enhanced oil recovery applications and for the removal of oil spillage, viz. an improved ability to emulsify oil/water and oil/brine systems and to stabilize emulsions of oil and water or brine, in particular at high temperature. Independently, the present invention seeks to provide a method for the manufacture of alkylarylsulfonate surfactants which is more versatile and economically more attractive than the known methods.

SUMMARY OF THE INVENTION

In accordance with this invention alkylarylsulfonate surfactants are prepared by dehydrogenating selected branched paraffins to produce branched olefins. These branched olefins can be converted into branched alkyl aromatics and subsequently into alkylarylsulfonate surfactants. It is an advantage of this invention that surfactants and intermediates can be made with a very low content of molecules which have a linear carbon chain. It is another advantage of the invention that products can be made of which the molecules have a low content of branches having three or more carbon atoms. It is also an advantage of the invention that products can be made of which the molecules have a low content of quaternary aliphatic carbon atoms. Without wishing to be bound by theory, it is believed that the presence of quaternary aliphatic carbon atoms in the molecules of the (branched-alkyl)arylsulfonate surfactants; prevents to some extent their biodegradation and the presence of quaternary aliphatic carbon atoms in the isoparaffinic composition is therefore preferably avoided. In fact, it has been determined that the presence of 0.5% or less quaternary aliphatic carbon atoms in the molecules of the surfactants renders the surfactants substantially more biodegradable.

Accordingly, the present invention provides a process for preparing branched olefins, which process comprises dehydrogenating an isoparaffinic composition over a suitable catalyst which isoparaffinic composition has been obtained by hydrocracking and hydroisomerization of a paraffinic wax and which isoparaffinic composition comprises paraffins having a carbon number in the range of from 7 to 35, of which paraffins at least a portion of the molecules is branched, the average number of branches per paraffin molecule being at least 0.5 and the branching comprising methyl and optionally ethyl branches.

The invention also provides a process for preparing branched alkyl aromatic hydrocarbons, which process comprises contacting branched olefins with an aromatic hydrocarbon under alkylating conditions, which branched olefins have been obtained by a process which comprises dehydrogenating an isoparaffinic composition over a suitable catalyst which isoparaffinic composition comprises paraffins having a carbon number in the range of from 7 to 35, of which paraffins at least a portion of the molecules is branched, the average number of branches per paraffin molecule being at least 0.5 and the branching comprising methyl and optionally ethyl branches.

The invention also provides a process for preparing (branched-alkyl)arylsulfonates, comprising sulfonating branched alkyl aromatic hydrocarbons which branched alkyl aromatic hydrocarbons have been prepared by the process for preparing branched alkyl aromatic hydrocarbons in accordance with this invention.

Further, the invention provides a branched olefin composition, which is obtainable in accordance with this invention.

Further, the invention provides a branched alkyl aromatic hydrocarbon composition which is obtainable in accordance with this invention.

In a further aspect the present invention provides a (branched-alkyl)arylsulfonate composition which is obtainable in accordance with this invention.

Without wishing to be bound by theory, it is believed that any improvement in the performance properties of the (branched-alkyl)arylsulfonates prepared in accordance with this invention, compared with the known (branched-alkyl) arylsulfonates, resides in a difference in the distribution of branching along the respective paraffinic chains. Such differences in the distribution of branching are truly unexpected in view of the prior art and, therefore, they are inventive.

DETAILED DESCRIPTION OF THE INVENTION

As described herein, the isoparaffinic composition and the compositions of branched olefins, branched alkyl aromatic compounds and (branched-alkyl)arylsulfonates derived therefrom are generally mixtures comprising molecules with different, consecutive carbon numbers. Typically at least 75% w, more typically at least 90% w, of these compositions represent a range of molecules of which the heaviest molecules comprises at most 6 carbon atoms more than the lightest molecules.

The isoparaffinic composition comprises paraffins having a carbon number in the range of from 7 to 35, of which paraffins at least a portion of the molecules is branched. Preferably, the isoparaffinic composition comprises paraffins having a carbon number in the range of from 7 to 18, more preferably from 10 to 18. Preferably at least 75% w, more preferably at least 90% w, of the isoparaffinic composition consists of paraffins having a carbon number in the range of from 10 to 18. In practice, frequently at most 99.99% w, more frequently at most 99.9% w, of the isoparaffinic composition consists of paraffins having a carbon number in the range of from 10 to 18. It is most preferred that the isoparaffinic composition comprises paraffins having a carbon number in the range of from 11 to 14, in which case preferably at least 75% w, more preferably at least 90% w, of the isoparaffinic composition consists of paraffins having a carbon number in the range of from 11 to 14. In practice, frequently at most 99.99% w, more frequently at most 99.9% w, of the isoparaffinic composition consists of paraffins having a carbon number in the range of from 11 to 14. These selections are based on the effects that the paraffins of a lower carbon number ultimately yield surfactants, which are more volatile, and that the paraffins of a higher carbon number ultimately yield surfactants with less water solubility.

The average number of branches per paraffin molecule present in the isoparaffinic composition is at least 0.5, calculated over the total of the branched paraffins and, if present, the linear paraffins. Suitably the average number of branches is at least 0.7, and more suitably at least 0.8, for example 1.0. Suitably the average number of branches is at most 2.0, preferably at most 1.8, and in particular at most 1.4.

The number of methyl branches present in the isoparaffinic composition is suitably at least 20%, more suitably at least 40%, preferably at least 50% of the total number of branches. In practice the number of methyl branches is frequently at most 99%, more frequently at most 98% of the total number of branches. If present, the number of ethyl branches is suitably at least 0.1%, in particular at least 1%, more in particular at least 2% of the total number of branches. Suitably, the number of ethyl branches is at most 20%, in particular at most 15%, more in particular at most 10% of the total number of branches. The number of any branches, if present, other than methyl and ethyl branches, may be less than 10%, in particular less than 5% of the total number of branches. The number of any branches, if present, other than methyl and ethyl branches, may be more than 0.1%, typically more than 1% of the total number of branches.

The number of quaternary aliphatic carbon atoms present in the isoparaffinic composition is preferably low. For applications where biodegradability is not as critical, the number of quaternary aliphatic carbon atoms is suitably less than 2% of the carbon atoms present, more suitably less than 1%. For any application, and particularly for applications where biodegradability is important, the number of quaternary aliphatic carbon atoms preferably is 0.5% or less, most preferably less than 0.5%, and in particular less than 0.3%. In practice the number of quaternary aliphatic carbon atoms present in the isoparaffinic composition is frequently more than 0.01% of the aliphatic carbon atoms present, more frequently more than 0.02%.

The content of branched paraffins of the isoparaffinic composition is typically at least 50% w, more typically at least 70% w, most typically at least 90% w, preferably at least 95% w, more preferably at least 99% w, in particular at least 99.9% w, relative to the weight of the isoparaffinic composition. In practice the content of branched paraffins is frequently at most 99.99% w, more frequently at most 99.95% w, relative to the weight of the isoparaffinic composition. The content of linear paraffins of the isoparaffinic composition is typically at most 50% w, more typically at most 30% w, most typically at most 10% w, preferably at most 5% w, more preferably at most 1% w, in particular at most 0.1% w, relative to the weight of the isoparaffinic composition. In practice the content of linear paraffins is frequently at least 0.01% w, more frequently at least 0.02% w, relative to the weight of the isoparaffinic composition.

The isoparaffinic composition may originate from various sources. For example, suitable isoparaffinic compositions may be selected from crude oil distillation fractions. Such crude oil distillation fractions may be treated to partially or, more preferably, completely remove sulfur and/or nitrogen containing components.

Alternatively, the isoparaffinic composition may be obtained by hydroisomerization of a paraffinic composition, i.e. a composition which comprises predominantly linear paraffins, such as obtainable from a Fischer Tropsch process or from an ethylene oligomerization process (after hydrogenation). Linear paraffins obtained in a Fischer Tropsch synthesis are particularly preferred because Fischer Tropsch products are generally very low in their content of sulfur and nitrogen and they are cost effective. The Fischer Tropsch products may or may not comprise oxygenates. The product obtained in the hydroisomerization process may be fractionated, for example, by distillation or otherwise, in order to isolate an isoparaffinic product of the desired composition. Such a hydroisomerization process and subsequent fractionation is known, for example from U.S. Pat No. 5,866,748, which is incorporated herein by reference.

Preferably, the isoparaffinic composition is obtained by hydrocracking and hydroisomerization of a paraffinic wax, in particular a slack wax, a wax obtained in a Fischer Tropsch synthesis or a polyethylene wax. The paraffinic wax comprises typically linear paraffins having at least 5 carbon atoms, preferably at least 15 carbon atoms, more preferably at least 25 carbon atoms. In practice, the paraffinic wax comprises frequently linear paraffins of which the number of carbon atoms may be high, for example up to 100 or up to 200 and even more. Paraffinic wax obtained in a Fischer Tropsch synthesis is particularly preferred because these are generally very low in their content of sulfur and nitrogen and they are cost effective. The product obtained in the hydrocracking/hydroisomerization process may be fractionated, for example, by distillation or otherwise, in order to isolate an isoparaffinic product of the desired composition. Such a hydrocracking/hydroisomerization process and subsequent fractionation is known, for example from U.S. Pat. No. 5,833,839, which is incorporated herein by reference. Generally, the hydrocracking/hydroisomerization process involves hydrocracking with simultaneous hydroisomerization.

The isoparaffinic composition may be treated to lower the content of linear paraffins, in order to favorably adjust the average number of branches in the isoparaffinic composition. Such separation may be accomplished by separation using a molecular sieve as absorbent. The molecular sieve may be, for example, a zeolite 4A, a zeolite 5A, a zeolite X or a zeolite Y. Reference, may be made to "Kirk-Othmer Encyclopedia of Chemical Technology", $4^{th}$ edition, Volume 1, pp. 589-590, and Volume 16, pp. 911-916; and "Handbook of Petroleum Refining Processes" (R A Meyers, Ed.), $2^{nd}$ edition, pp. 10.45-10.51, 10.75-10.77. These references are incorporated herein by reference.

Catalysts suitable for the dehydrogenation of the isoparaffinic composition may be selected from a wide range. For example, they may be based on a metal or metal compound deposited on a porous support, the metal or metal compound being one or more selected for example from chrome oxide, iron oxide and, preferably, the noble metals. The noble metals are understood to be the metals of the group formed by platinum, palladium, iridium, ruthenium, osmium and rhodium. Preferred noble metals are palladium and, in particular platinum.

Suitable porous supports may be supports of a carbon nature such as activated carbon, coke and charcoal; silica or silica gel, or other natural or synthetic clays or, silicates, for example hydrotalcites; ceramics; refractory inorganic oxides such as alumina, titania or magnesia; naturally or synthetic crystalline aluminosilicates such as mordenite or faujasite; and combinations of two or more elements selected from these groups. The porous support is preferably an alumina, in particular gamma alumina or eta alumina.

The quantity of the metal or metal compound deposited on the porous support is not material to this invention. The quantity may suitably be selected in the range of from 0.01 to 5% w, preferably from 0.02 to 2% w, based on the weight of the catalyst.

Further metals may be present in the catalyst used for the dehydrogenation of the isoparaffinic composition, in particular in the catalysts which comprise a noble metal. Such further metals may suitably be selected from Group 3a, Group 4a and Group 5a of the Periodic Table of Elements (cf. R C Weast (Ed,) "Handbook of Chemistry and Physics", $54^{th}$ edition, CRC Press, inside cover). In particular, indium may be selected from Group 3a, tin may be selected from Group 4a or bismuth may be selected from Group 5a. Especially suitable further metals are alkali and alkaline earth metals. Preferred alkali metals are potassium, and in particular lithium.

Further elements which may be present in the catalyst used for the dehydrogenation of the isoparaffinic composition are halogens, in particular in combination with a metal of Group 4a, more in particular in combination with tin. Chlorine is a preferred halogen.

The quantity of such further metals or halogens may independently be in the range of from 0.01 to 5% w, preferably from 0.02 to 2% w, based on the weight of the catalyst.

Suitable catalysts for the dehydrogenation of the isoparaffinic composition are, for example, chrome oxide on gamma alumina, platinum on gamma alumina, palladium on gamma alumina, platinum/lithium on gamma alumina, platinum/potassium on gamma alumina, platinum/tin on gamma alumina, platinum/tin on hydrotalcite, platinum/indium on gamma alumina and platinum/bismuth on gamma alumina.

The dehydrogenation may be operated at a wide range of conditions. Suitably the temperature is in the range of from 300° C. to 700° C., more suitably in the range of from 400° C. to 600° C., in particular in the range of from 450° C. to 550° C. The total pressure may be an elevated pressure, such as in the range of from 1.1 to 15 bara (i.e. bar absolute), preferably in the range of from1.3 to 10 bara, in particular in the range of from 1.5 to 5 bara. In order to prevent coking, hydrogen may be fed together with the isoparaffinic composition. Suitably, hydrogen and paraffins present in the isoparaffinic composition are fed at a molar ratio in the range of from 0.1 to 20, more suitable this molar ratio is in the range of from 0.5 to 15, in particular this molar ratio is in the range of from 1 to 10.

The residence time in the dehydrogenation is typically selected such that conversion level of the isoparaffinic composition is kept below 50 mole %, preferably in the range of from 5 to 30 mole %, in particular in the range of from 10 to 20 mole %. By keeping the conversion level low, side reactions may to some extent be prevented, such as diene formation and cyclization reactions. Non-converted paraffins and dehydrogenated compounds may be separated from the dehydrogenation product and, if desired, non-converted paraffins may be recycled to the dehydrogenation step. Such separation may be accomplished by extraction, by extractive distillation or, preferably, by using a molecular sieve as absorbent. The molecular sieve may be, for example, a zeolite 4A, a zeolite 5A, a zeolite X or a zeolite Y. If desired, linear olefins may be separated at least to some extent from branched olefin so that the content of branched olefin in the product as obtained from the dehydrogenation is increased further, but this option is generally not preferred.

The skilled person is aware of the techniques of preparing the catalysts, performing the dehydrogenation step and performing associated separation steps, for use in this invention. For example, suitable procedures for preparing catalysts and performing the dehydrogenation are known from U.S. Pat. Nos. 5,012,021, 3,274,287, 3,315,007, 3,315,008, 3,745,112, 4,430,517, incorporated herein by reference. For techniques suitable for the separation of branched olefins from linear olefins, reference may be made to "Kirk-Othmer Encyclopedia of Chemical Technology", $4^{th}$ edition, Volume 1, pp. 589-591, and Volume 16, pp. 911-916; and "Handbook of Petroleum Refining Processes" (R A Meyers, Ed.), 2nd edition, pp. 10.45-10.51, 10.79-10.81. These references are incorporated herein by reference.

The dehydrogenation in accordance with this invention yields typically a branched olefin composition comprising olefins having a carbon number in the range of from 7 to 35, of which olefins at least a portion of the molecules is branched, the average number of branches per molecule being at least 0.5 and the branching comprising methyl and optionally ethyl branches. Preferably, the branched olefin composition comprises olefins having a carbon number in the range of from 7 to 18, more preferably from 10 to 18.

Preferably at least 75% w, more preferably at least 90% w, of the branched olefin composition consists of olefins having a carbon number in the range of from 10 to 18. In practice, frequently at most 99.99% w, more frequently at most 99.9% w, of the branched olefin composition consists of olefins having a carbon number in the range of from 10 to 18. It is most preferred that the branched olefin composition comprises olefins having a carbon number in the range of from 11 to 14, in which case preferably at least 75% w, more preferably at least 90% w, of the branched olefin composition consists of olefins having a carbon number in the range of from 11 to 14. In practice, frequently at most 99.99% w, more frequently at most 99.9% w, of the branched olefin composition consists of olefins having a carbon number in the range of from 11 to 14.

Suitably the average number of branches per olefin molecule present in the branched olefin composition is at least 0.7, and more suitably at least 0.8, for example 1.0. Suitably the average number of branches is at most 2.0, preferably at most 1.8, and in particular at most 1.4. The number of methyl branches is suitably at least 20%, more suitably at least 40%, preferably at least 50% of the total number of branches. In practice the number of methyl branches is frequently at most 99%, more frequently at most 98% of the total number of branches. If present, the number of ethyl branches is suitably at least 0.1%, in particular at least 1%, more in particular at least 2% of the total number of branches. Suitably, the number of ethyl branches is at most 20%, in particular at most 15%, more in particular at most 10% of the total number of branches. The number of any branches, if present, other than methyl and ethyl branches, may be less than 10%, in particular less than 5% of the total number of branches. The number of any branches, if present, other than methyl and ethyl branches, may be more than 0.1%, typically more than 1% of the total number of branches.

The number of quaternary aliphatic carbon atoms present in the branched olefins is preferably low. For applications where biodegradability is not as critical, the number of quaternary aliphatic carbon atoms is suitably less than 2% of the carbon atoms present, more suitably less than 1%. For any application, and particularly for applications where biodegradability is important, the number of quaternary aliphatic carbon atoms preferably is 0.5% or less, most preferably less than 0.5%, and in particular less than 0.3%. In practice the number of quaternary aliphatic carbon atoms present in the branched olefins is frequently more than 0.01% of the aliphatic carbon atoms present, more frequently more than 0.02%.

The content of branched olefins of the branched olefin composition is typically at least 50% w, more typically at least 70% w, most typically at least 90% w, preferably at least 95% w, more preferably at least 99% w, in particular at least 99.9% w, relative to the weight of the branched olefin composition. In practice the content of branched olefins is frequently at most 99.99% w, more frequently at most 99.95% w, relative to the weight of the branched olefin composition. The content of linear olefins of the branched olefin composition is typically at most 50% w, more typically at most 30% w, most typically at most 10% w, preferably at most 5% w, more preferably at most 1% w, in particular at most 0.1% w, relative to the weight of the branched olefin composition. In practice the content of linear olefins is frequently at least 0.01% w, more frequently at least 0.05% w, relative to the weight of the branched olefins composition.

The branched olefin composition may comprise paraffins, which were not converted in the dehydrogenation. Such non-converted paraffins may suitably be removed in a subsequent stage, in particular during the work-up of the alkylation reaction mixture, as described hereinafter, and recycled to the dehydrogenation step. If the branched olefin composition comprises paraffins, the specifications given in the three paragraphs preceding the present paragraph relate to the olefinic portion of the branched olefin composition. Typically quantity of the olefinic portion present in the branched olefin composition is in the range of from 1 to 50% mole relative to the total number of moles of olefins and paraffins present, more typically in the range of from 5 to 30% mole, in particular from 10 to 20% mole, on the same basis. Typically quantity of the paraffinic portion present in the branched olefin composition is in the range of from 50 to 99% mole relative to the total number of moles of olefins and paraffins present, more typically in the range of from 70 to 95% mole, in particular from 80 to 90% mole, on the same basis.

The preparation of branched alkyl aromatic hydrocarbons by contacting the branched olefins with the aromatic hydrocarbon may be performed under a large variety of alkylating conditions. Preferably, the said alkylation leads to monoalkylation, and only to a lesser degree to dialkylation or higher alkylation, if any.

The aromatic hydrocarbon applicable in the alkylation may be one or more of benzene; toluene; xylene, for example o-xylene or a mixture of xylenes; and naphthalene. Preferably, the aromatic hydrocarbon is benzene.

The molar ratio of the branched olefins to the aromatic hydrocarbons may be selected from a wide range. In order to favor monoalkylation, this molar ratio is suitably at least 0.5, preferably at least 1, in particular at least 1.5. In practice this molar ratio is frequently less than 1000, more frequently less than 100.

The said alkylation may or may not be carried out in the presence of a liquid diluent. Suitable diluents are, for example, paraffin mixtures of a suitable boiling range, such as the paraffins which were not converted in the dehydrogenation and which were not removed from the dehydrogenation product. An excess of the aromatic hydrocarbon may act as a diluent.

The alkylation catalyst, which may be applied, may be selected for example from a large range of zeolitic alkylation catalysts. In order to favor monoalkylation, it is preferred that the zeolitic alkylation catalysts have pore size dimensions in the range of from 4 to 9 Å, more preferably from 5 to 8 Å and most preferably from 5.5 to 7 Å, on the understanding that when the pores have an elliptical shape, the larger pore size dimension is the dimension to be considered. The pore size dimensions of zeolites has been specified in W M Meier and D H Olson, "Atlas of Zeolite Structure Types", $2^{nd}$ revised edition (1987), published by the Structure Commission of the International Zeolite Association. Suitable zeolitic alkylation catalysts are zeolites in acidic form selected from zeolite Y and zeolites ZSM-5 and ZSM-11. Preferably the zeolitic alkylation catalysts are zeolites in acidic form selected from mordenite, ZSM-4, ZSM-12, ZSM-20, offretite, gemelinite and cancrinite. Particularly preferred zeolitic alkylation catalysts are the zeolites which have an NES zeolite structure type, including isotypic framework structures such as NU-87 and gottardite, as disclosed in U.S. Pat. No. 6,111,158. The zeolites which have an NES zeolite structure type give, advantageously, a high selectivity to 2-aryl-alkanes. Further examples of suitable zeolitic alkylation catalyst have been given in WO-99/05082.

Suitably, the zeolitic alkylation catalyst has a molar ratio of Si to Al of at least 5:1 and suitably at most 500:1, in particular at most 100:1. In particular when the zeolitic alkylation catalyst is of the NES zeolite structure type, the molar ratio of Si to Al is preferably in the range of from 5:1 to 25:1, more preferably from 10:1 to 20:1. The molar ratio of Si to Al of the zeolitic alkylation catalyst is meant to be the molar ratio of the $SiO_4$ tetrahedra to the $AlO_4$ tetrahedra, i.e. the framework Si/Al molar ratio.

The zeolitic alkylation catalyst has preferably at least a portion of the cationic sites occupied by ions other than alkali or alkaline earth metal ions. Such replacing ions could be one or more selected from the group of for example ammonium, hydrogen and rare earth. In a preferred embodiment the zeolitic alkylation catalyst is at least partly in the hydrogen form, i.e. acidic form, in particular completely in the hydrogen form. Suitably at least 10%, preferably at least 50%, more preferably at least 90% of the cationic sites is occupied by hydrogen ions. In practice, frequently at most 99%, more frequently at most 95% of the cationic sites is occupied by hydrogen ions. This is generally accomplished by exchange of the alkali metal ion or another ion for a hydrogen ion precursors, e.g. ammonium ions, which upon calcination yields the hydrogen form.

It is preferred that the zeolitic alkylation catalyst is used in pellet form comprising for example at least 1% w, typically at least 50% w, preferably at least 90% w of the zeolitic alkylation catalyst. A conventional binder may be present in the pellets. Useful conventional binders may be inorganic materials, such as clay, silica and/or metal oxides. The zeolitic alkylation catalyst may be compounded with other materials, such as porous matrix materials, for example, alumina, silica/alumina, silica/magnesia, silica/zirconia and silica/titania, silica/alumina/thoria and silica/alumina/zirconia.

Processes for treatment the zeolitic alkylation catalyst or of precursors thereof to prepare an active form of the zeolitic alkylation catalyst are given in WO-99/05082, which is herein incorporated by reference. Examples of such treatments are ion exchange reactions, dealumination, steaming, calcination in air, in hydrogen or in an inert gas, and activation.

The zeolitic alkylation catalyst is suitably applied in a quantity of from 0.5 to 100% w, preferably from 1 to 50% w, relative to the weight of the branched olefins applied.

The preparation of branched alkyl aromatic hydrocarbons by contacting the branched olefins with the aromatic hydrocarbon may be performed under alkylating conditions involving reaction temperatures selected from a large range. The reaction temperature is suitably selected in the range of from 30° C. to 300 C., more suitably in the range of from 100° C. to 250° C.

Work-up of the alkylation reaction mixture may be accomplished by methods known in the art. For example, a solid catalyst may be removed from the reaction mixture by filtration or centrifugation. Unreacted hydrocarbons, for example branched olefins, any excess of intake aromatic hydrocarbons or paraffins, may be removed by distillation.

The general class of branched alkyl aromatic compounds which may be made in accordance with this invention can be characterized by the chemical formula R-A, wherein R represents a radical derived from the branched olefins according to this invention by the addition thereto of a hydrogen atom, which branched olefins have a carbon number in the range of from 7 to 35, in particular from 7 to 18, more in particular from 10 to 18, most in particular from 11 to 14; and A represents an aromatic hydrocarbyl radical, in particular a phenyl radical.

The branched alkyl aromatic compounds of this invention may be sulfonated by any method of sulfonation which is known in the art. Examples of such methods include sulfonation using sulfuric acid, chlorosulfonic acid, oleum or sulfur trioxide. Details of a preferred sulfonation method, which involves using an air/sulfur trioxide mixture, are known from U.S. Pat. No. 3,427,342.

Any convenient work-up method may be employed after the sulfonation. The sulfonation reaction mixture may be neutralized with a base to form the (branched-alkyl)arylsulfonate in the form of a salt. Suitable bases are the hydroxides of alkali metals and alkaline earth metals; and ammonium hydroxides, which provide the cation M of the salts as specified below.

The general class of (branched-alkyl)arylsulfonates which may be made in accordance with this invention can be characterized by the chemical formula $(R\text{-}A'\text{-}SO_3)_nM$, wherein R represents a radical derived from the branched olefins according to this invention by the addition thereto of a hydrogen atom, which branched olefins have a carbon number in the range of from 7 to 35, in particular from 7 to 18, more in particular from 10 to 18, most in particular from 11 to 14; A' represents a divalent aromatic hydrocarbyl radical, in particular a phenylene radical; M is a cation selected from an alkali metal ion, an alkaline earth metal ion, an ammonium ion, and mixtures thereof; and n is a number depending on the valency of the cation(s) M, such that the total electrical charge is zero. The ammonium ion may be derived from an organic amine having 1, 2 or 3 organic groups attached to the nitrogen atom. Suitable ammonium ions are derived from monoethanol amine, diethanol amine and triethanol amine. It is preferred that the ammonium ion is of the formula $NH_4^+$. In preferred embodiments M represents potassium or magnesium, as potassium ions can promote the water solubility of the (branched-alkyl)arylsulfonates and magnesium, can promote their performance in soft water.

The (branched-alkyl)arylsulfonate surfactants which can be made in accordance with this invention may be used as surfactants in a wide variety of applications, including detergent formulations such as granular laundry detergent formulations, liquid laundry detergent formulations, liquid dishwashing detergent formulations; and in miscellaneous formulations such as general purpose cleaning agents, liquid soaps, shampoos and liquid scouring agents.

The (branched-alkyl)arylsulfonate surfactants find particular use in detergent formulations, specifically laundry detergent formulations. These formulations are generally comprised of a number of components, besides the (branched-alkyl)arylsulfonate surfactants themselves: other surfactants of the ionic, nonionic, amphoteric or cationic type, builders, cobuilders, bleaching agents and their activators, foam controlling agents, enzymes, anti-greying agents, optical brighteners, and stabilizers.

The present liquid laundry detergent formulations may comprise the same components as the granular laundry detergent formulations, but they generally contain less of the inorganic builder component. Hydrotropes may be present in the liquid detergent formulations. General purpose cleaning agents may comprise other surfactants, builders, foam control agents, hydrotropes and solubilizer alcohols.

The present formulations may contain a large amount of the builder and cobuilder components, in amounts up to 90w %, preferably between 5 and 35w %, based on the weight of the formulation, to intensify the cleaning action. Examples of common inorganic builders are phosphates, polyphosphates, alkali metal carbonates, silicates and sulfates. Examples of organic builders are polycarboxylates, aminocarboxylates such as ethylenediaminotetraacetates, nitrilotriacetates, hydroxycarboxylates, citrates, succinates and substituted and unsubstituted alkanedi- and polycarboxylic acids. Another type of builder, useful in granular laundry and built liquid laundry agents, includes various substantially water-insoluble materials which are capable of reducing the water hardness e.g. by ion exchange processes. In particular the complex sodium aluminosilicates, known as type A zeolites, are very useful for this purpose.

The present formulations may also contain percompounds with a bleaching action, such as perborates, percarbonates, persulfates and organic peroxy acids. Formulations containing percompounds may also contain stabilizing agents, such as magnesium silicate, sodium ethylenediaminetetraacetate or sodium salts of phosphonic acids. In addition, bleach activators may be used to increase the efficiency of the inorganic persalts at lower washing temperatures. Particularly useful for this purpose are substituted carboxylic acid amides, e.g., tetraacetylethylenediamine, substituted carboxylic acids, e.g., isononyloxybenzenesulfonate and sodiumcyanamide.

Examples of suitable hydrotropic substances are alkali metal salts of benzene, toluene and xylene sulfonic acids; alkali metal salts of formic acid, citric and succinic acid, alkali metal chlorides, urea, mono-, di-, and triethanolamine. Examples of solubilizer alcohols are ethanol, isopropanol, mono- or polyethylene glycols, monopropylene glycol and etheralcohols.

Examples of foam control agents are high molecular weight fatty acid soaps, paraffinic hydrocarbons, and silicon containing de-foamers. In particular hydrophobic silica particles are efficient foam control agents in these laundry detergent formulations.

Examples of known enzymes which are effective in the laundry detergent formulations are protease, amylase and lipase. Preference is given to the enzymes which have their optimum performance at the design conditions of the washing and cleaning agent.

A large number of fluorescent whiteners are described in the literature. For the laundry washing formulations, the derivatives of diaminostilbene disulfonates and substituted distyryibiphenyl are particularly suitable.

As antigreying agents, water soluble colloids of an organic nature are preferably used. Examples are water soluble polyanionic polymers such as polymers and copolymers of acrylic and maleic acid, cellulose derivatives such as carboxymethyl cellulose methyl- and hydroxyethylcellulose.

The (branched-alkyl)arylsulfonate surfactants which can be made in accordance with this invention may also advantageously be used in personal care products, in enhanced oil recovery applications and for the removal of oil spillage off-shore and on inland water-ways, canals and lakes.

The formulations according to the invention typically comprise one or more inert components. For instance, the balance of liquid detergent formulations is typically an inert solvent or diluent, most commonly water. Powdered or granular detergent formulations typically contain quantities of inert filler or carrier materials.

As used herein, the average number of branches per molecule, further particulars of the type and position of branching and the content of quaternary aliphatic carbon atoms are as defined in U.S. Pat. No. 5,849,960 and they are determined by the methods as described in U.S. Pat. No. 5,849,960. Also the further analytical methods and the test methods are as described in U.S. Pat. No. 5,849,960. U.S. Pat. No. 5,849,960 is incorporated herein by reference.

Unless specified otherwise, the low-molecular weight organic compounds mentioned herein have typically at most 40 carbon atoms, more typically at most 20 carbon atoms, in particular at most 10 carbon atoms, more in particular at most 6 carbon atoms. Organic compounds are deemed to be compounds which comprise carbon atoms and hydrogen atoms in their molecules. The group of low-molecular weight organic compounds does not include polymers and enzymes.

As defined herein, ranges for numbers of carbon atoms (i.e. carbon number) include the numbers specified for the limits of the ranges. Number of carbon atoms as defined herein include the carbon atoms along the carbon backbones, as well as branching carbon atoms, if any.

The following example will illustrate the nature of the invention without its scope.

EXAMPLE 1

Prophetic

A Fischer Tropsch hydrocarbon mixture of linear paraffins having at least 5 carbon atoms, further comprising a minor quantity of oxygenates, is subjected to conditions of hydrocracking and hydroisomerization by contacting the hydrocarbon mixture, in the presence of hydrogen, with a palladium on silica-alumina catalyst (0.5% w Pd, 55% w $Al_2O_3$, 45% w $SiO_2$) at a temperature of 350° C. and at a pressure of 60 bara, applying a liquid hourly space velocity of 0.5. l/l/h and a hydrogen to wax feed ratio of 400 Nl/l (liquid volumes at 20° C., "Nl" refers to the gas volume at 0° C., 1 bar).

The hydrocracking/hydroisomerization product stream is fractionated by distillation and by separation over a molecular sieve zeolite 5A such that an isoparaffinic composition is obtained which consists of branched and linear paraffins having a carbon number in the range of from 10 to 15. The average number of branches is 1.9 per paraffin molecule. The number of methyl branches is 60% of the total number of branches. The number of ethyl branches is 15% of the total number of branches. The quantity of branched paraffins present in the isoparaffinic composition is more than 96% w, and the quantity of linear paraffins present in the isoparaffinic composition is less than 4% w, based on the weight of the isoparaffinic composition.

The isoparaffinic composition is subjected to conditions of dehydrogenation by contacting the isoparaffinic composition, in the presence of hydrogen, with a platinum on gamma alumina catalyst (0.5% w platinum) at a temperature of 490° C. and at a pressure of 2.5 bara, applying in the feed a hydrogen/paraffins molar ratio of 4. The residence time of the isoparaffinic composition is controlled such that the conversion is 15%.

The dehydrogenation product is fractionated by separation over a molecular sieve zeolite 5A to remove paraffins. A paraffin free olefin fraction is obtained.

The olefin fraction is reacted with benzene under alkylating conditions, at a molar ratio of benzene to the olefins of 20, at a temperature of 190° C. and in the presence of an acidic mordenite catalyst in a quantity of 15% w relative to the weight of the olefin fraction.

The alkylation product is isolated and purified by filtration and removing the volatile components by distillation.

The isolated, purified alkylation product is then sulfonated by a known method.

EXAMPLE 2

Prophetic

The procedure of example 1 is repeated, except that the separation over a molecular sieve is omitted, and that the quantity of branched paraffins present in the isoparaffinic composition obtained is 70% w and the quantity of linear paraffins present in the isoparaffinic composition obtained is 30% w, based on the weight of the isoparaffinic composition, and in the isoparaffinic composition obtained the average number of branches is 1.3 per paraffin molecule. In other aspects the isoparaffinic composition is as indicated in example 1.

EXAMPLE 3

Prophetic

The procedure of example 1 is repeated, except that the Fischer Tropsch hydrocarbon mixture consists essentially of a wax of linear paraffins having at least 30 carbon atoms. The isoparaffinic composition obtained is of a similar composition as specified in example 1.

EXAMPLE 4

Prophetic

The procedure of example 3 is repeated, except that the separation over a molecular sieve is omitted, and that the quantity of branched paraffins present in the isoparaffinic composition obtained is 90% w and the quantity of linear paraffins present in the isoparaffinic composition obtained is 10% w, based on the weight of the isoparaffinic composition, and in the isoparaffinic composition obtained the average number of branches is 1.7 per paraffin molecule. In other aspects the isoparaffinic composition is as indicated in example 1.

EXAMPLEs 5-8

Prophetic

The procedures of examples 1-4 are repeated except that in each case the isoparaffinic composition obtained consists of branched and linear paraffins having a carbon number in the range of from 10 to 14, instead of from 10 to 15. In other aspects the isoparaffinic compositions obtained are as indicated in the respective example of examples 1-4.

EXAMPLEs 9-16

Prophetic

The procedures of examples 1-8 are repeated except that in each procedure the removal of paraffins from the dehydrogenation product is omitted and that, instead, paraffins are removed from the alkylation products by distillation. In each procedure a paraffin free alkylation product is obtained and subsequently sulfonated.

EXAMPLE 17

$C_{9-22}$ branched paraffins produced by polymerization using methane and syn gas ($H_2$ and CO) as starting materials were hydrocracked, producing branched paraffins, separated by distillation, and fractions were collected. The individual fractions were analyzed for carbon number distribution. Based on the analyses, selected fractions were blended together to meet the specification on carbon number distribution as follows: <10% $C_{10}$; <2% $C_{14}$; balance $C_{11}$-$C_{13}$ (hereinafter collectively "$C_{11}$-$C_{13}$ paraffins.")

The following analytical data contain structural information about the resulting branched paraffin. Note: Samples A and B in the table below are the same sample, analyzed at different times. Sample B should be more accurate, as it is the more recent and reflects some small improvements in the analytical method over time.

A sample of $C_{11}$-$C_{13}$ paraffins was dehydrogenated essentially using known dehydrogenation techniques. In order to run NMR analysis and confirm that the dehydrogenation process does not cause any significant changes in the skeletal structure of the resulting olefin, the resulting product, was re-hydrogenated using a commercial platinum on carbon catalyst and, the resulting product, sample C in the table, was analyzed using the same method as was used for samples A and B. The results are contained in column C of the first table and the first set of NMR data.

| | SAMPLE | | | | |
|---|---|---|---|---|---|
| | A | B | C | Control 1 | Control 2 |
| Ratio branched paraffins to linear paraffins = | 1.9 | 1.8 | 1.8 | 2.6 | 2.6 |
| Ratio mmp paraffins to linear paraffins = | 0.9 | 0.9 | 0.9 | 2.4 | 2.5 |
| Ratio highly branched paraffins to linear paraffins = | 1.0 | 0.9 | 0.9 | 0.1 | 0.1 |

The NMR data and chromatographic data gave information on carbon chain length distribution and structure:

| NMR Branching Analysis of Dehydrogenated Paraffins | |
|---|---|
| Number of carbons in alkane chain | 12 (from GC data) |
| Branching Index | 1.1 |
| % Overall Type of Branching | |
| C1 (methyl) | 79.3 |
| C2 (ethyl) | 19.4 |
| C3+ (propyl+) | 1.3 |

| NMR Branching Analysis of Rehydrogenated Paraffins | |
|---|---|
| Number of carbons in alkane chain | 12 (from GC data) |
| Branching Index | 1.1 |
| % Overall Type of Branching | |
| C1 (methyl) | 73.7 |
| C2 (ethyl) | 21.6 |
| C3+ (propyl+) | 4.6 |

The "Alcohol End Branching Analysis (C-1 refers to alcohol carbon)" box describes branching in the molecule as it pertains to the location of such branches relative to the alcohol end of the molecule. When branching is present next door to the alcohol carbon (C2 carbon), the NMR is able to actually differentiate between, methyl, ethyl and propyl or longer branch types. When branching is on the carbon two away from the alcohol carbon (C3), NMR can only tell that there is a branch but can't tell if it is a methyl, an ethyl or a propyl or longer. By the time you are three bonds away from the alcohol carbon, the NMR can't tell if there is any kind of branching. So, the entry "% no branching or branching at the C4+ position" coadds linear molecules as well as molecules that have branching 3+ bonds away from the alcohol carbon.

The "% Overall Type of Branching" box gives the amounts of C1 (methyl), C2 (ethyl) and C3+ (propyl or longer) branches in the molecule irrespective of where these branches might occur relative to the alcohol end.

NMR analysis of the candidate sample showed a quaternary carbon content below 0.5%. Molecules containing quaternary carbons are known to be difficult to biodegrade. Hence, a quaternary carbon content below 0.5% renders these materials very useful and quicker to biodegrade.

EXAMPLE 18

Using the procedures described in Example 17, the quaternary carbon content of alcohol molecules found in a competitive product were measured. The competitive product was a highly methyl branched alcohol prepared by oligomerization of propylene followed by hydroformylation, which converted the olefin into a highly methyl branched alcohol. The quaternary carbon content was approximately 0.6. U.S. Pat. No. 5,112,519 describes this product as Aa highly methyl branched tridecyl alcohol known for its use in lubricants and detergent formulations which does not require rapid biodegradation.@

EXAMPLE 19

Prophetic

The $C_{11}$-$C_{13}$ paraffins from Example 17 are subjected to the conditions outlined in Example 1 to produce a paraffin free olefin fraction.

The olefin fraction is reacted with benzene under alkylating conditions, at a molar ratio of benzene to the olefins of 20, at a temperature of 190° C. and in the presence of an acidic mordenite catalyst in a quantity of 15% w relative to the weight of the olefin fraction.

The alkylation product is isolated and purified by filtration and removing the volatile components by distillation. The isolated, purified alkylation product is then sulfonated by a known method.

It is apparent that certain features of the invention, which are for clarity described in the context of separate embodiments, may also be provides in combination in a single embodiment. Conversely, features of the invention which are described in the context of a single embodiment may also be provided separately or in any suitable sub-combination

What is claimed is:

1. A process for preparing a product comprising branched olefins, said process comprising:

hydrocracking and hydroisomerizing a paraffinic wax to produce an isoparaffinic composition comprising 0.5% or less quaternary carbon atoms, said isoparaffinic composition comprising paraffins having a carbon number of from about 7 to about 18, at least a portion of said paraffins being branched paraffins comprising an average number of branches per paraffin molecule of at least 0.5, said branches comprising a first number of methyl branches and optionally a second number of ethyl branches, said branched paraffins comprising a range of molecules of which the heaviest molecules comprise at most 6 carbon atoms more than the lightest molecules;

exposing said isoparaffinic composition to a dehydrogenation catalyst in an amount and under dehydrogenation conditions effective to dehydrogenate said branched paraffins and to produce said branched olefins comprising 0.5% or less quaternary aliphatic carbon atoms.

2. The process of claim 1 wherein said isoparaffinic composition and said branched olefins comprise 0.3% or less quaternary aliphatic carbon atoms.

3. The process of claim 1 wherein said isoparaffinic composition comprises at least about 50% w of said branched paraffins.

4. The process of claim 1 wherein at least 90% w of said branched paraffins comprise a range of molecules of which the heaviest molecules comprises at most 6 carbon atoms more than the lightest molecules.

5. The process of claim 1 wherein said paraffins have a carbon number in the range of from 7 to 35.

6. The process of claim 1 wherein at least 75% w of said isoparaffinic composition consists of paraffins having a carbon number in the range of from 10 to 18.

7. The process of claim 1 wherein at least 90 w % of said isoparaffinic composition consists of paraffins having a carbon number in the range of from 10 to 18.

8. The process of claim 1 wherein at least 75% w of said isoparaffinic composition consists of paraffins having a carbon number in the range of from 11 to 14.

9. The process of claim 1 wherein at least 90% w of said isoparaffinic composition consists of paraffins having a carbon number in the range of from 11 to 14.

10. The process of claim 1 wherein said average number of branches is at least 0.7.

11. The process of claim 1 wherein said average number of branches is at most 2.0.

12. The process of claim 1 wherein said average number of branches is at most 1.8.

13. The process of claim 1 wherein said average number of branches is at most 1.4.

14. The process of claim 1 wherein said first number of methyl branches is at least 50%.

15. The process of claim 1 wherein said second number of ethyl branches is at most 10%.

16. A process for preparing a product comprising branched olefins, said process comprising:

hydrocracking and hydroisomerizing a paraffinic wax to produce an isoparaffinic composition comprising less than 0.5% quaternary aliphatic carbon atoms, said isoparaffinic composition comprising paraffins having a carbon number of from about 7 to about 18, at least a portion of said paraffins being branched paraffins comprising an average number of branches per paraffin molecule of at least 0.5, said branches comprising a first number of methyl branches and optionally a second number of ethyl branches; and, exposing said isoparaffinic composition to a dehydrogenation catalyst in an amount and under dehydrogenation conditions effective to dehydrogenate said branched paraffins and to produce said branched olefins comprising less than 0.5% quaternary aliphatic carbon atoms wherein said dehydrogenation conditions comprise a residence time effective to maintain a conversion level of said isoparaffinic composition below about 50 mole %.

17. The process of claim 1 wherein said isoparaffinic composition comprises at least about 50% w of said branched paraffins.

18. The process of claim 1 wherein said isoparaffinic composition comprises at most 10% w linear paraffins.

19. The process of claim 1 wherein said isoparaffinic composition comprises at most 5% w linear paraffins.

20. The process of claim 1 wherein said isoparaffinic composition is produced by a Fischer Tropsch process.

21. The process of claim 1 wherein said isoparaffinic composition is obtained from an ethylene oligomerization process.

22. The process of claim 1 wherein said isoparaffinic composition is treated with an absorbent under conditions effective to perform a function selected from the group consisting of reducing linear paraffin content, favorably adjusting said average number of branches, and a combination thereof.

23. The process of claim 1 wherein said dehydrogenation catalyst comprises a quantity of metal or metal compound selected from the group consisting of chrome oxide, iron oxide and, noble metals.

24. The process of claim 1 wherein said dehydrogenation catalyst comprises a quantity of noble metal selected from the group consisting of platinum, palladium, iridium, ruthenium, osmium and rhodium.

25. The process of claim 1 wherein said dehydrogenation catalyst comprises a quantity of noble metal selected from the group consisting of palladium and platinum.

26. The process of claim 1 wherein said dehydrogenation catalyst comprises a quantity of platinum.

27. The process of claim 23 wherein said dehydrogenation catalyst further comprises a porous support selected from the group consisting of activated carbon; coke; charcoal; silica; silica gel; synthetic clays; and silicates.

28. The process of claim 23 wherein said dehydrogenation catalyst further comprises a porous support selected from the group consisting of gamma alumina or eta alumina.

29. The process of claim 23 where said quantity of metal or metal compound is from about 0.01 to 5% w based on the weight of the catalyst.

30. The process of claim 24 wherein said catalyst further comprises from about 0.01 to about.5% w of one or more metals selected from the group consisting of Group 3a, Group 4a and Group 5a of the Periodic Table of Elements.

31. The process of claim 24 wherein said catalyst further comprises from about 0.01 to about 5% w of one or more metals selected from the group consisting of alkali earth metals and alkaline earth metals.

32. The process of claim 24 wherein said catalyst further comprises from about 0.01 to about 5% w of one or more metals selected from the group consisting of indium, tin, bismuth, potassium, and lithium.

33. The process of claim 24 wherein said catalyst further comprises from about 0.01 to about 5% w of one or more halogens.

34. The process of claim 24 wherein said catalyst further comprises from about 0.01 to about 5% w independently of tin and chlorine.

35. The process of claim 1 wherein said catalyst is selected from the group consisting of chrome oxide on gamma alumina, platinum on gamma alumina, palladium on gamma alumina, platinum/lithium on gamma alumina, platinum/potassium on gamma alumina, platinum/tin on gamma alumina, platinum/tin on hydrotalcite, platinum/indium on gamma alumina and platinum/bismuth on gamma alumina.

36. The process of claim 1 wherein said dehyrogenation conditions comprise a temperature of from about 300° C. to about 700° C. and a pressure of from about 1.1 to 15 bar absolute.

37. The process of claim 1 wherein hydrogen is fed to said dehydrogenation catalyst with said isoparaffinic composition.

38. The process of claim 37 wherein said hydrogen and said paraffins are fed at a molar ratio of from about 0.1 to about 20.

39. The process of claim 1 wherein said branched olefins comprise non-converted paraffins and said process further comprises separating said non-converted paraffins from said branched olefin product and recycling said non-converted paraffins to said dehydrogenation catalyst.

40. The process of claim 39 wherein said separating comprises exposing said product comprising non-converted paraffins to molecular sieves.

41. The process of claim 40 wherein said molecular sieves are zeolites.

42. The process of claim 1 wherein said branched olefin product comprises from about 1 to about 50% mole olefins relative to the total number of moles of olefins and paraffins present.

43. The process of claim 1 wherein said branched olefin product comprises from about 10 to about 20% mole olefins relative to the total number of moles of olefins and paraffins present in said product.

* * * * *